United States Patent [19]

Partin et al.

[11] 3,972,104

[45] Aug. 3, 1976

[54] SLEEVE PULLING DEVICE

[76] Inventors: Roy A. Partin, P.O. Box 64, Loveland, Ohio 45140; Meredith A. Herbert, Rte. 1, Box 57A, Fayetteville, Ohio 45118

[22] Filed: Sept. 17, 1975

[21] Appl. No.: 614,266

[52] U.S. Cl. ..... 29/280; 294/93; 29/282

[51] Int. Cl.[2] ..... B25B 27/14

[58] Field of Search ..... 29/282, 280; 81/90 B, 81/90 C, 72; 294/93, 26, 27 R

[56] References Cited

UNITED STATES PATENTS

| | | | |
|---|---|---|---|
| 1,655,744 | 1/1928 | Swanby | 294/93 UX |
| 2,439,907 | 4/1948 | Poglein | 294/26 |
| 3,805,359 | 4/1974 | Webb | 29/282 |

*Primary Examiner*—James L. Jones, Jr.
*Attorney, Agent, or Firm*—James W. Pearce; Roy F. Schaeperklaus

[57] ABSTRACT

A sleeve pulling device that includes a pair of telescoping members, each of which has a boss at an outer end thereof. The bosses are received and fit snugly in opposed openings in the sleeve. A handle is attached to one of the telescoping members.

3 Claims, 6 Drawing Figures

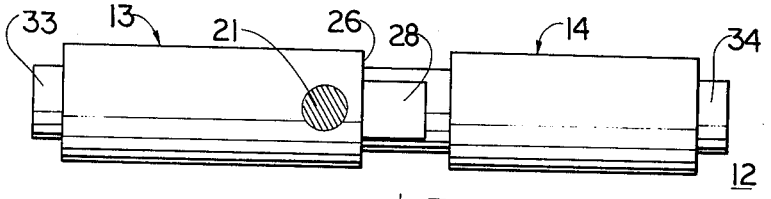
FIG. 4
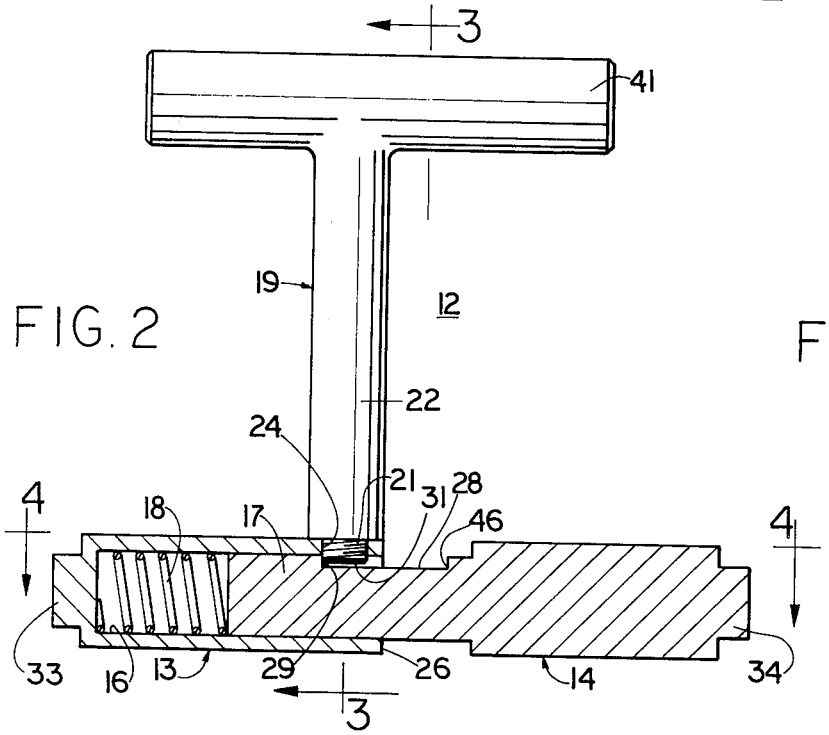
FIG. 2
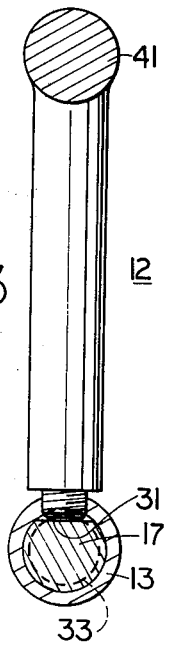
FIG. 3
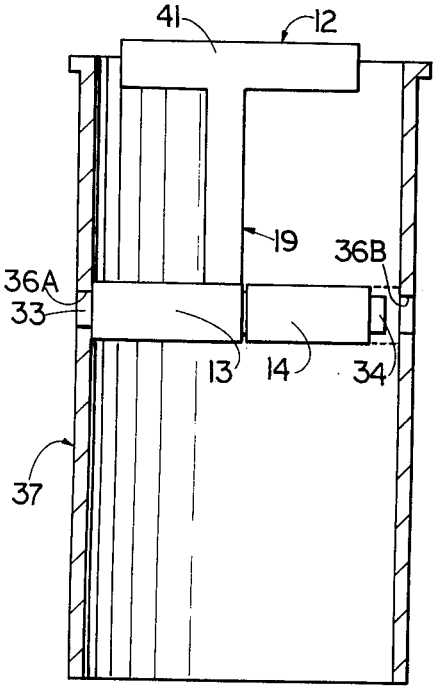
FIG. 1
FIG. 6
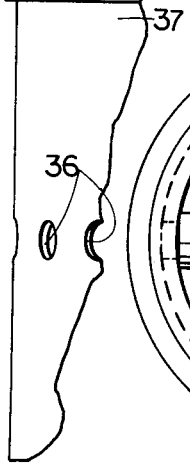
FIG. 5
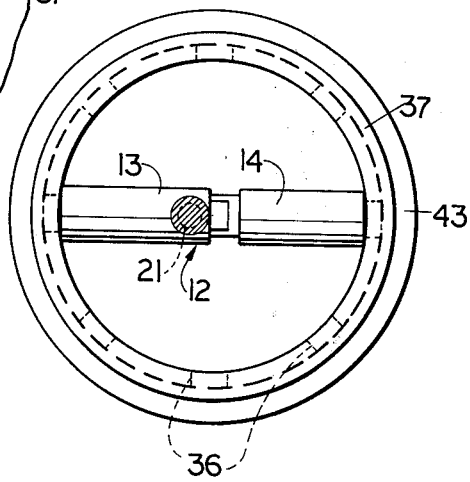

SLEEVE PULLING DEVICE

This invention relates to a device for removing a cylinder liner or sleeve or the like from a cylinder of an internal combustion engine.

An object of this invention is to provide a device for pulling a cylinder liner which can readily be inserted into the cylinder liner and which firmly engages and grips the cylinder liner.

A further object of this invention is to provide such a device which has outwardly projecting bosses which fit snugly in cylinder sleeve openings to firmly grip the cylinder liner.

A further object of this invention is to provide such a device which can readily be introduced into the cylinder liner with the bosses thereof retracted and in which the bosses are urged outwardly into the cylinder liner openings.

A further object of this invention is to provide such a device in which a handle is mounted on the device and is accessible from outside the cylinder liner for use in pulling the liner.

Briefly, this invention provides a device for pulling a liner sleeve from a cylinder of an internal combustion engine which includes a pair of telescoping members. Bosses at outer ends of the members are received and fit snugly in openings at opposite sides of the liner sleeve. A spring urges the members to extended position. The members can be moved inwardly to cause release of the bosses from the liner sleeve openings. A handle is mounted in one of the members. A portion of the handle is engageable with the other member to keep the members in assembled relation. The handle can be grasped for withdrawing the liner sleeve from the cylinder.

The above and other objects and features of the invention will be apparent to those skilled in the art to which this invention relates from the following detailed description and the drawing, in which:

FIG. 1 is a view in transverse section of a cylinder liner with a cylinder liner puller constructed in accordance with an embodiment of this invention being shown in position therein, a portion of the puller being shown in retracted position in full lines and in advanced position is dashed lines;

FIG. 2 is a view in transverse section of the puller shown in FIG. 1;

FIG. 3 is a view in section taken generally on the line 3—3 in FIG. 2;

FIG. 4 is a view in section taken on the line 4—4 in FIG. 2;

FIG. 5 is a top plan view of an open cylinder showing the cylinder wall with liner in position in the cylinder and with the puller in position therein, a handle of the puller being broken away to reveal details of construction; and FIG. 6 is a fragmentary view in side elevation of the liner.

In the following detailed description and the drawing, like reference characters indicate like parts.

In FIGS. 1–5 inclusive of the drawing is shown a sleeve pulling device 12 constructed in accordance with an embodiment of this invention. The device 12 includes telescoping members 13 and 14 (FIG. 2). The member 13 includes a central socket 16 having a cylindrical wall inside which an end portion 17 of the member 14 is telescopically received. A compression spring 18 is mounted in the socket 16 and urges the telescoping members 13 and 14 toward extended position.

A generally T-shaped handle 19 is mounted on the telescoping member 13. A lower tip 21 of an upright portion 22 of the handle 19 is threaded in a radial bore 24 in the wall of the member 13 adjacent an open end 26 thereof. The telescoping member 14 is provided with a flat face 28 parallel to the axis thereof having a shoulder 29 at an end thereof which can engage the lower tip 21 of the handle portion 22 to limit movement of the member 14 under the influence of the spring 18. The tip 21 has a flat bottom face 31 which is engageable by the flat face 28 of the telescoping member 14 to limit relative turning of the telescoping members 13 and 14.

At an outer end of the telescoping member 13 is provided a boss 33. A similar boss 34 is provided at the outer end of the telescoping member 14. Each of the bosses 33 and 34 is of a size to be received snugly inside one of a plurality of radial bores or sleeve openings 36 (FIG. 6) in a cylinder liner 37. The telescoping members 13 and 14 can be retracted to the position shown in FIG. 1 to permit entry of the sleeve pulling device 12 into the sleeve 37 to permit the bosses 33 and 34 to enter diametrically opposed openings 36A and 36B in the sleeve 37, as shown in dashed lines in FIG. 1. A cross bar 41 of the handle 19 can be grasped for pulling the sleeve 37 from a cylinder 43 (FIG. 5). Retraction of the telescoping members 13 and 14 is limited by a shoulder 46 on the member 14 which is engageable with the tip 21 of the handle portion 22.

The sleeve pulling device illustrated in the drawing and described above is subject to structural modification without departing from the spirit and scope of the appended claims.

Having described our invention, what we claim as new and desire to secure by letters patent is:

1. A device for pulling a cylinder sleeve from a cylinder which comprises a pair of telescoping members, one of the telescoping members having a lengthwise socket, the other of the telescoping members including a portion slidably mounted in the lengthwise socket, a boss at an outer end of each of the telescoping members, means urging the telescoping members to an extended position in which the bosses are receivable in opposed openings in the sleeve, and a handle attached to one of the telescoping members, the handle including an end portion extending through a transverse opening in the first telescoping member and into the socket, the portion of the other telescoping member received in the socket having means engageable with the end portion of the handle to limit outward movement of the telescoping members.

2. A device as in claim 1 wherein the means engageable with the end portion of the handle to limit outward movement of the telescoping members is a shoulder at an end of a slot in the other telescoping member and a second shoulder at an opposite end of the slot is engageable with the end portion of the handle to limit inward movement of the telescoping members.

3. A device as in claim 1 wherein the means for urging the telescoping members to extended position is a compression spring mounted in the socket and bearing on the other telescoping member.

* * * * *